US006621202B2

(12) United States Patent
Kimiya et al.

(10) Patent No.: US 6,621,202 B2
(45) Date of Patent: Sep. 16, 2003

(54) CATHODE RAY TUBE APPARATUS INCLUDING AN ELECTRON GUN ASSEMBLY CAPABLE OF DYNAMIC ASTIGMATISM COMPENSATION

(75) Inventors: Junichi Kimiya, Kumagaya (JP); Syunji Ookubo, Kumagaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 86 days.

(21) Appl. No.: 09/818,841

(22) Filed: Mar. 28, 2001

(65) Prior Publication Data

US 2001/0028212 A1 Oct. 11, 2001

(30) Foreign Application Priority Data

Mar. 29, 2000 (JP) ..... 2000-091021

(51) Int. Cl.[7] ..... H01J 29/50; H01J 29/46

(52) U.S. Cl. ..... 313/414; 313/460; 313/409; 313/441; 315/15; 315/402; 315/379

(58) Field of Search ..... 313/414, 412, 313/413, 426–428, 448, 449, 441, 452, 460; 315/14–17, 370, 382, 395, 402

(56) References Cited

U.S. PATENT DOCUMENTS 5,488,265 A * 1/1996 Chen ..... 313/414
5,631,521 A * 5/1997 Hasegawa et al. ..... 313/414
5,663,609 A * 9/1997 Kamohara et al. ..... 313/412
5,694,004 A * 12/1997 Kimiya et al. ..... 315/15

FOREIGN PATENT DOCUMENTS

JP 64-38947 2/1989
JP 7-220648 8/1995

OTHER PUBLICATIONS

S. Sugawara, et al., "A New Dynamic Focus Electron Gun for Color CRTs with Tri–Quadrupole Electron Lens", SID Digest, pp. 103–106 (May 1995).

* cited by examiner

*Primary Examiner*—Nimeshkumar D. Patel
*Assistant Examiner*—German Colón
(74) *Attorney, Agent, or Firm*—Oblon, Spivak, McClelland, Maier & Neustadt, P.C.

(57) ABSTRACT

A main lens is composed of a dynamic focus electrode, a first auxiliary electrode, a second auxiliary electrode and an anode, which are successively arranged in a direction of travel of electron beams. A sub-lens provided on a cathode side of the main lens is composed of a third grid, a fourth grid and a fifth grid. The first auxiliary electrode is connected to the fourth grid, and both are connected to a voltage supply terminal on a resistor near the fourth grid. A fixed focus voltage is applied to the third grid and fifth grid sandwiching the fourth grid.

9 Claims, 5 Drawing Sheets

CATHODE RAY TUBE APPARATUS INCLUDING AN ELECTRON GUN ASSEMBLY CAPABLE OF DYNAMIC ASTIGMATISM COMPENSATION

CROSS-REFERENCE TO RELATED APPLICATIONS

This application is based upon and claims the benefit of priority from the prior Japanese Patent Application No. 2000-091021, filed Mar. 29, 2000, the entire contents of which are incorporated herein by reference.

BACKGROUND OF THE INVENTION

The present invention relates generally to a cathode ray tube apparatus, and more particularly to a cathode ray tube apparatus incorporating an electron gun assembly capable of compensating dynamic astigmatism.

A color cathode ray tube apparatus, in general terms, comprises an in-line electron gun assembly for emitting three electron beams, and a deflection yoke for generating deflection magnetic fields, thereby deflecting the electron beams emitted from the electron gun structure and horizontally and vertically scanning them over a phosphor screen. The deflection yoke forms a non-uniform magnetic field by generating a pincushion-type horizontal deflection magnetic field and a barrel-type vertical deflection magnetic field.

The electron beams, while passing through the non-uniform magnetic field, are affected by a deflection aberration, i.e. astigmatism in the deflection magnetic fields. Consequently, the beam spots of electron beams landing on peripheral portions of the phosphor screen are distorted, and the resolution deteriorates. Jpn. Pat. Appln. KOKAI Publication No. 64-38947 discloses a dynamic focus type electron gun assembly as means for solving the problem of deterioration in resolution due to deflection aberration.

FIG. 10 shows this electron gun assembly having a main lens ML. The main lens ML is composed of a dynamic focus electrode G5, to which a dynamic focus voltage Vd is applied, an anode G6, to which an anode voltage Eb is applied, and auxiliary electrodes GM1 and GM2 disposed therebetween. Voltages obtained by dividing the anode voltage Eb by means of a resistor 100 disposed near the electron gun assembly are applied to the auxiliary electrodes GM1 and GM2.

Thus, asymmetric lenses QL1 and QL2 are formed, respectively, between the dynamic focus electrode G5 and auxiliary electrode GM1, and between the auxiliary electrode GM2 and anode G6. As the electron beams are deflected toward the peripheral portion of the phosphor screen, the dynamic focus electrode G5 is supplied with the dynamic focus voltage Vd and the asymmetric lens QL1 performs a diverging function only in the vertical direction, without performing a lens function in the horizontal direction.

With these lens functions, this electron gun assembly corrects the distortion of electron beam spots on the peripheral portion of the phosphor screen.

In this electron gun assembly, however, since the dynamic focus voltage is applied to the dynamic focus electrode G5, a capacitance is created among the electrodes of the main lens ML, and due to the capacitance, part of an AC component of the dynamic focus voltage is superimposed on the voltages applied to the auxiliary electrodes GM1 and GM2. As a result, the asymmetric lens QL1 created between the dynamic focus electrode G5 and auxiliary electrode GM1 has a deficient lens action, and the asymmetric lens QL2 created between the auxiliary electrode GM2 and anode G6 has an undesirable lens action.

Accordingly, distortion of the beam spot on the peripheral portion of the phosphor screen cannot fully be corrected, and it is difficult to obtain good focus characteristics over the entire phosphor screen.

In a case where the main lens ML includes, as shown in FIG. 10, two or more auxiliary electrodes (GM1 and GM2) supplied with voltage from the resistor 100 disposed near the electron gun assembly, it is disadvantageous, in terms of breakdown voltage, to dispose voltage supply terminals 110 and 120 in a near position on the resistor 100.

Where voltage supply lead wires for supplying voltage to the auxiliary electrodes GM1 and GM2 are to be led out of the resistor 100, it is preferable for the purpose of easier work to dispose the voltage supply terminals 110 and 120 of the resistor 100 near the auxiliary electrodes GM1 and GM2. As a result, where there are two or more auxiliary electrodes (GM1 and GM2), the two or more voltage supply terminals (110 and 120) are positioned close to each other on the resistor 100.

In this case, an electric discharge will easily occur between the two or more voltage supply terminals (110 and 120) and a problem of breakdown voltage may arise.

In order to solve this problem, in an electron gun assembly as shown in FIG. 11, a second auxiliary electrode G6 is disposed away from the first auxiliary electrode GM1, that is, between two focus electrodes G5 and G7. The second auxiliary electrode G6 is connected to the first auxiliary electrode GM1 and is supplied with voltage from a voltage supply terminal on the resistor 100 disposed near the secondary auxiliary electrode G6. Accordingly, the distance between the voltage supply terminal 110 for voltage supply to the first auxiliary electrode GM1 and second auxiliary electrode G6 can be located sufficiently away from the voltage supply terminal 120 for voltage supply to the auxiliary electrode GM2. Thus, a problem of breakdown voltage can be solved.

Even with this structure, however, it is necessary to additionally provide the electron gun assembly with the second auxiliary electrode G6, and the total number of electrodes of the electron gun assembly increases, resulting in an increase in cost. Moreover, the number of electron lenses formed within the electron gun assembly increases, and an error tends to occur in the trajectories of electron beams.

In the structure of the prior-art electron gun assembly, as described above, an AC component of the dynamic focus voltage is superimposed on the voltage applied to the adjacent electrode, and the electron lens formed by these electrodes causes an undesirable lens action. It is thus difficult to satisfactorily correct the distortion of the beam spots of electron beams deflected onto the peripheral portions of the phosphor screen.

Moreover, with the prior-art electron gun assembly, where the two or more auxiliary electrodes supplied with a part of anode voltages divided by the resistor are disposed close to each other, the voltage supply terminals on the resistor are also disposed close to each other. This is disadvantageous in terms of breakdown voltage.

Furthermore, in order to eliminate the disadvantage on breakdown voltage, the structure may be adopted wherein a second auxiliary electrode is additionally disposed away from a plurality of closely-arranged first auxiliary electrodes, one of the first auxiliary electrodes is electrically connected to the second auxiliary electrode, and the voltage supply terminals are provided on the resistor disposed near the second auxiliary electrode. In this case, however, the total number of electrodes of the electron gun assembly increases, resulting in an increase in cost. Besides, the number of electron lenses formed within the electron gun assembly increases, and an error tends to occur in the trajectories of electron beams.

Consequently, the focus characteristics deteriorate over the entire phosphor screen, and it is difficult to obtain well-shaped beam spots.

BRIEF SUMMARY OF THE INVENTION

The present invention has been made in consideration of the above problems, and the object of the invention is to provide a cathode ray tube apparatus wherein a disadvantage on breakdown voltage is eliminated and well-shaped beam spots can be formed over an entire phosphor screen without increasing manufacturing cost.

In order to achieve the object, a cathode ray tube apparatus according to claim 1 comprising:

an electron gun assembly including an electron beam generating section for generating at least one electron beam, and a main focus lens section for focusing the electron beam on a screen; and a deflection yoke for generating deflection magnetic fields for deflecting and scanning the electron beam from the electron gun assembly on the screen in horizontal and vertical directions, wherein the main focus lens section comprises at least one focus electrode, to which a fixed focus voltage of a first level is applied, at least one anode to which an anode voltage of a second level higher than the first level is applied, at least one first auxiliary electrode to which a voltage obtained by resistor-dividing the anode voltage via a resistor and having a third level higher than the first level and lower than the second level is applied, and at least one dynamic focus electrode to which a dynamic focus voltage obtained by superimposing on a focus voltage an AC voltage varying in synchronism with the deflection magnetic fields generated by the deflection yoke is applied, the main focus lens section includes an ultimate main focus lens section composed of the dynamic focus electrode, the at least one first auxiliary electrode and the anode, which are arranged successively in a direction of travel of the electron beam, and at least one second auxiliary electrode connected to the first auxiliary electrode is provided on the electron beam generating section side of the ultimate main focus lens section, and an electrode to which a fixed voltage is applied is disposed near the second auxiliary electrode such that an induction voltage induced in the first auxiliary electrode of the ultimate main focus lens section may be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of a cathode ray tube apparatus according to the present invention will now be described with reference to the accompanying drawings.

Figure 3:
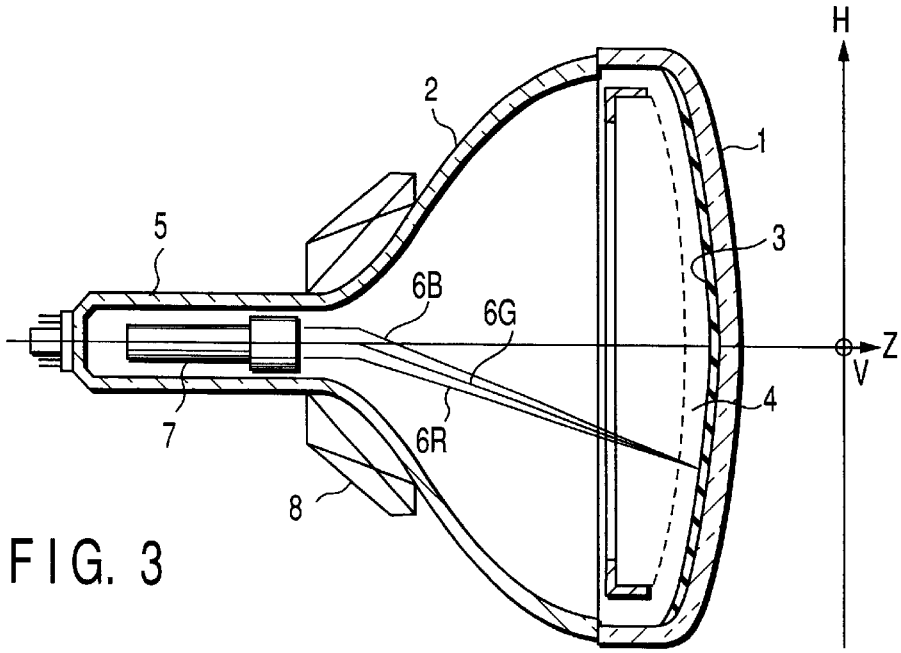
FIG. 3 is a horizontal cross-sectional view schematically showing the structure of the cathode ray tube apparatus of the invention.

As is shown in FIG. 3, the cathode ray tube apparatus of this invention, e.g. a color cathode ray tube apparatus, has an envelope comprising a panel 1 and a funnel 2 integrally coupled to the panel 1. The panel 1 has a phosphor screen 3 on its inner surface. The phosphor screen 3 comprises striped or dotted three-color phosphor layers that emit blue, green and red light. A shadow mask 4 is disposed to face the phosphor screen 3 and has many apertures at its inner part.

The funnel 2 includes an in-line electron gun assembly 7 disposed in a neck 5 thereof. The electron gun assembly 7 emits three in-line electron beams 6B, 6G and 6R in a tube axis direction Z, i.e. one central beam 6G and a pair of side beams 6B and 6R traveling in a single horizontal plane. In the electron gun assembly 7, the positions of side beam passage holes in a low-voltage side grid and high-voltage side grid of a main lens section are deviated to self-converge the three electron beams on the central portion of the phosphor screen 3.

A deflection yoke 8 is mounted on an outer surface of the funnel 2. The deflection yoke 8 generates a non-uniform magnetic field for deflecting the three electron beams 6B, 6G and 6R in a horizontal direction H and a vertical direction V, which have been emitted from the electron gun assembly 7. The non-uniform deflection magnetic field is produced by a pincushion-shaped horizontal deflection magnetic field and a barrel-shaped vertical deflection magnetic field.

The three electron beams 6B, 6G and 6R emitted from the electron gun assembly 7 are self-converged toward the phosphor screen 3 and focused on the associated phosphor layers of the phosphor screen 3. The three electron beams are scanned in the horizontal direction H and vertical direction V of the phosphor screen 3 by the non-uniform deflection magnetic field. Thus, a color image is displayed.

Figure 1:
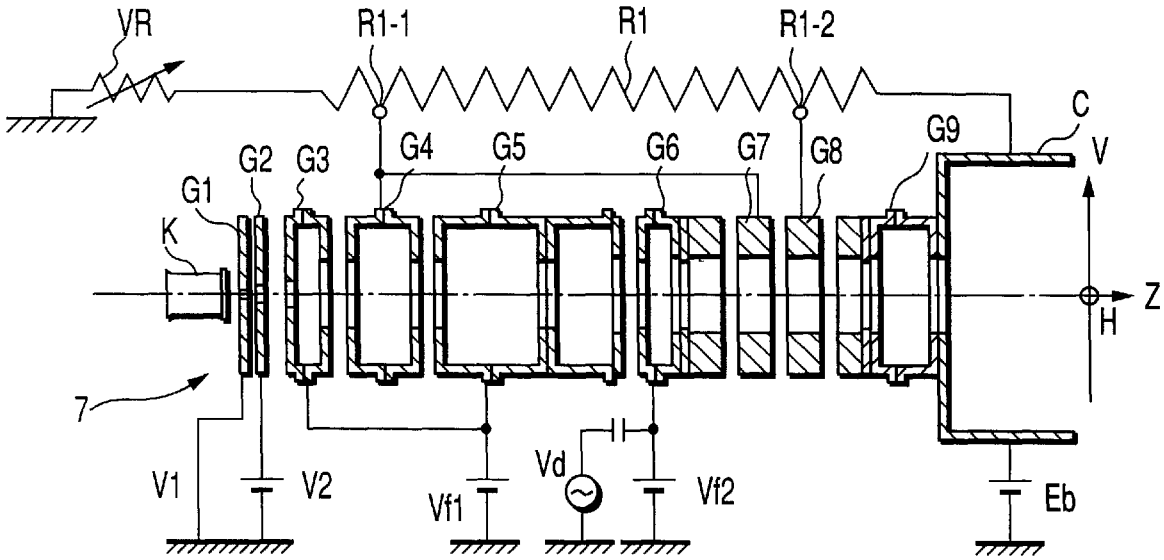
FIG. 1 is a vertical cross-sectional view schematically showing an embodiment of an electron gun assembly having an acceleration-type sub-lens, which is applied to a cathode ray tube apparatus of the present invention.

The electron gun assembly 7 applied to this cathode ray tube apparatus, as shown in FIG. 1, comprises cathodes K, a first grid G1, a second grid G2, a third grid G3 (focus electrode), a fourth grid G4 (second auxiliary electrode), a fifth grid G5 (focus electrode), a sixth grid G6 (dynamic focus electrode), a seventh grid G7 (first auxiliary electrode), an eighth grid G8 (first auxiliary electrode), a ninth grid G9 (anode), and a convergence cup C. These grids and convergence cup are arranged in the named order in the direction of travel of the electron beams and are fixed on an insulating support member.

The first grid G1 is grounded (or supplied with a minus voltage V1). The second grid G2 is supplied with a low acceleration voltage V2 from the outside of the cathode ray tube. The acceleration voltage V2 is 500 V to 1 KV.

The third grid G3 and fifth grid G5 are connected within the tube and supplied with a first focus voltage Vf1 of a constant intermediate level from the outside of the cathode ray tube. The first focus voltage Vf1 corresponds to about 22% to 32% of an anode voltage Eb, and is, for instance, 6 to 10 KV.

A dynamic focus voltage (Vf2+Vd) is applied to the sixth grid G6 from the outside of the cathode ray tube. The dynamic focus voltage is obtained by superimposing an AC voltage Vd, which is synchronized with a deflection magnetic field generated by the deflection yoke, on a second focus voltage Vf2 that is substantially equal to the first focus voltage Vf1. Like the first focus voltage Vf1, the second focus voltage Vf2 corresponds to about 22% to 32% of the anode voltage Eb, and is, for instance, 6 to 10 KV. The AC voltage Vd varies in a range of 0 V to 300–1500 V in synchronism with the deflection magnetic field.

The ninth grid G9 and convergence cup C are connected and supplied with the anode voltage Eb from the outside of the cathode ray tube. The anode voltage Eb is 25 to 35 KV.

As is shown in FIG. 1, a resistor R1 is provided near the electron gun assembly 7. The resistor R1 is connected at one end to the convergence cup C and grounded at the other end via a variable resistor outside the tube. An intermediate portion of the resistor R1 is provided with voltage supply terminals R1-1 and R1-2 for supplying voltages to the grids of the electron gun assembly 7.

The fourth grid G4 and seventh grid G7 are connected within the tube and connected to the voltage supply terminal R1-1 on the resistor R1 near the fourth grid G4. A voltage obtained by resistor-dividing the anode voltage Eb, e.g. a voltage of about 35% to 45% of the anode voltage Eb, is applied to the fourth grid G4 and seventh grid G7 via the voltage supply terminal R1-1.

The eighth grid G8 is connected to the voltage supply terminal R1-2 on the resistor R1 in the vicinity of the eighth grid G8. A voltage obtained by resistor-dividing the anode voltage Eb, e.g. a voltage of about 50% to 70% of the anode voltage Eb, is applied to the eighth grid G8 via the voltage supply terminal R1-2.

The first grid G1 is composed of a thin plate-like electrode. The plate-like electrode has, in its plate face, three small-diameter circular electron beam passage holes corresponding to the three cathodes K arranged in line in the horizontal direction. The second grid G2 is composed of a thin plate-like electrode. This plate-like electrode has, in its plate face, three circular electron beam passage holes corresponding to the three cathodes K. The diameter of each electron beam passage hole formed in the second grid G2 is slightly greater than that of each hole formed in the first grid G1.

The third grid G3 is formed by abutting and coupling opening end portions of two cup-shaped electrodes each extending in the tube axis direction Z. The cup-shaped electrode, which faces the second grid G2, has, in its end face, still larger three circular electron beam passage holes corresponding to the three cathodes K. The cup-shaped electrode, which faces the fourth grid G4, has, in its end face, three large-diameter circular electron beam passage holes corresponding to the three cathodes K.

The fourth grid G4 is formed by abutting and coupling opening end portions of two cup-shaped electrodes each extending in the tube axis direction Z. The cup-shaped electrode, which faces the third grid G3, has, in its end face, three large-diameter circular electron beam passage holes corresponding to the three cathodes K. The cup-shaped electrode, which faces the fifth grid G5, has, in its end face, three large-diameter circular electron beam passage holes corresponding to the three cathodes K.

The fifth grid G5 is composed of three cup-shaped electrodes each extending in the tube axis direction Z and one thin plate-shaped electrode. Opening end portions of two of the three cup-shaped electrodes, which are located closer to the fourth grid G4, are abutted upon each other. An end face of the other cup-shaped electrode, which is closer to the sixth electrode, is abutted upon an end face of an adjacent one of the aforementioned two cup-shaped electrodes. An opening end of the cup-shaped electrode, which is closer to the sixth grid G6, is abutted upon the thin plate-shaped electrode. The end face of each of the three cup-shaped electrodes has three large-diameter electron beam passage holes corresponding to the three cathodes K. The plate-shaped electrode facing the sixth grid G6 has, in its plate face, three oval electron beam passage holes extending in the vertical direction V or three circular electron beam passage holes, which correspond to the three cathodes K.

The sixth grid G6 comprises two cup-shaped electrodes each having a shorter length in the tube axis direction Z, one thin plate-shaped electrode and one thick plate-shaped electrode. Opening end portions of the two cup-shaped electrodes, which are located on the fifth grid G5 side, are abutted upon each other. An end face of the cup-shaped electrode, which is located on the seventh grid G7 side, is abutted upon the thin plate-shaped electrode. The thin plate-shaped electrode is abutted upon the thick plate-shaped electrode. The end face of the cup-shaped electrode facing the fifth grid G5 has three oval electron beam passage holes elongated in the horizontal direction H, which correspond to the three cathodes K. The end face of the cup-shaped electrode, which is located on the seventh grid G7 side, has three large-diameter circular electron beam passage holes corresponding to the three cathodes K. The thin plate-shaped electrode has, in its plate face, three oval large-diameter electron beam passage holes elongated in the horizontal direction H, which correspond to the three cathodes K. The thick plate-shaped electrode facing the seventh grid G7 has, in its plate face, three large-diameter circular electron beam passage holes corresponding to the three cathodes K.

The seventh grid G7 and eighth grid G8 are composed of thick plate-shaped electrodes. Each of these plate-shaped electrodes has, in its plate face, three large-diameter circular electron beam passage holes corresponding to the three cathodes K.

The ninth grid G9 comprises a thick plate-shaped electrode, a thin plate-shaped electrode and two cup-shaped electrodes. The thick plate-shaped electrode facing the eighth grid G8 is abutted upon the thin plate-shaped electrode. The thin plate-shaped electrode is abutted upon an end face of the cup-shaped electrode located on the eighth grid G8 side. Opening end portions of the two cup-shaped electrodes are abutted upon each other. The thick plate-shaped electrode facing the eighth grid G8 has three large-diameter circular electron beam passage holes corresponding to the three cathodes K. The thin plate-shaped electrode has, in its plate face, three oval large-diameter electron beam passage holes elongated in the horizontal direction H, which correspond to the three cathodes K. Each of the end faces of the two cup-shaped electrodes has three large-diameter circular electron beam passage holes corresponding to the three cathodes K.

An end face of the convergence cup C is abutted upon the end face of the cup-shaped electrode of the ninth grid G9. The end face of the convergence cup C has three large-diameter circular beam passage holes corresponding to the three cathodes K.

In the electron gun assembly 7 with the above structure, an electron beam generating section is composed of the cathodes K, first grid G1 and second grid G2. The electron beam generating section generates electron beams and forms object points for a main lens. A prefocus lens is composed of the second grid G2 and third grid G3. The prefocus lens prefocuses the electron beams generated from the electron beam generating section.

A main focus lens section is composed of the third grid G3 to ninth grid G9. In the main focus lens section, a sub-lens is constituted by the third grid G3, fourth grid G4 and fifth grid G5. The sub-lens further prefocuses the electron beams that have been prefocused by the prefocus lens. In addition, in the main focus lens section, a main lens (ultimate main focus lens section) is constituted by the sixth grid G6, seventh grid G7, eighth grid G8 and ninth grid G9. The main lens ultimately focuses the prefocused electron beams onto the phosphor screen.

A quadrupole lens, whose lens power dynamically varies in accordance with a deflection amount of electron beams, is formed between the fifth grid G5 and beams, is formed between the fifth grid G5 and sixth grid G6 by applying the voltage, on which the AC voltage Vd varying in accordance with the deflection amount of electron beams, to the sixth grid G6. As the electron beams are deflected from the center of the screen to peripheral portions, the quadrupole lens functions to focus the electron beams in the horizontal direction H and to diverge the electron beams in the vertical direction V in a relative manner.

An asymmetric lens having different lens powers in the horizontal direction and vertical direction is formed between the sixth grid G6 and seventh grid G7 of the main lens. The asymmetric lens has a function of focusing the electron beams in the vertical direction V and of diverging the electron beams in the horizontal direction H. As the electron beams are deflected from the center of the screen to peripheral portions, the lens power of the asymmetric lens is varied by the AC voltage Vd varying in accordance with the deflection amount of electron beams and the asymmetric lens functions to diverge the electron beams in the vertical direction V and to focus electron beams in the horizontal direction H in a relative manner.

An asymmetric lens having different lens powers in the horizontal direction H and vertical direction V between the eighth grid G8 and ninth grid G9 of the main lens. The asymmetric lens has a function of diverging the electron beams in the vertical direction V and of focusing electron beams in the horizontal direction H.

As has been described above, the fourth grid G4 is disposed between the paired focus electrodes, i.e. the third grid G3 and fifth grid G5, to which the fixed first focus voltage Vf1 is applied. The seventh grid G7 of the main lens is electrically connected to the fourth grid G4. Thus, the ratio of superimposition of the AC voltage component in the dynamic focus voltage, which is superimposed on the grid GM1 and grid GM2 of the prior-art main lens, can be reduced.

Figure 4:
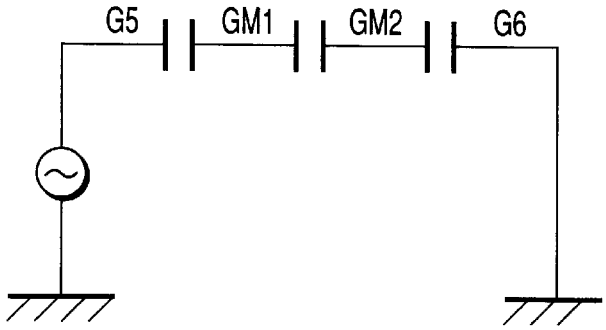
FIG. 4 PRIOR ART
FIG. 4 is a view for explaining an equivalent circuit of a main lens in a prior-art electron gun assembly.
Figure 5:
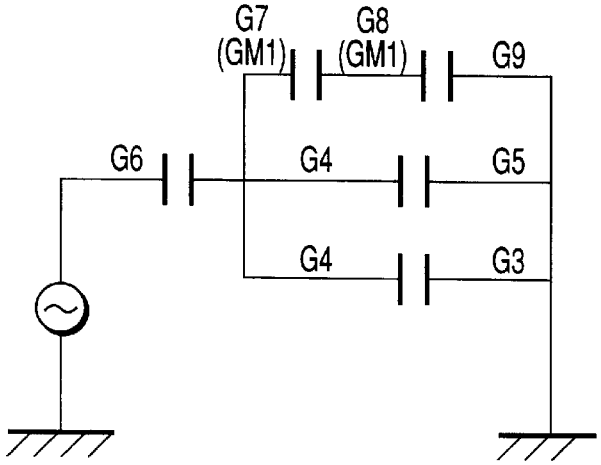
FIG. 5 PRIOR ART
FIG. 5 is a view for explaining an equivalent circuit of a main lens in the electron gun assembly shown in FIG. 1.
Figure 10:
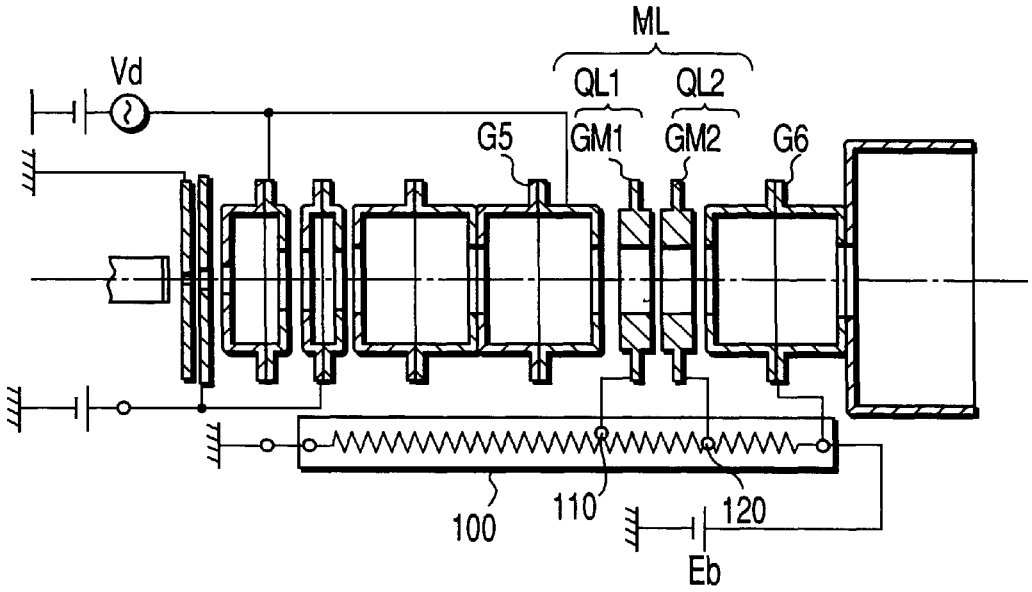
FIG. 10 PRIOR ART
FIG. 10 schematically shows the structure of a prior art electron gun assembly having a main lens corresponding to the equivalent circuit shown in FIG. 4.

FIGS. 4 and 5 show equivalent circuits of the prior art and the present invention for comparison. FIG. 4 shows an equivalent circuit of the main lens of the prior-art electron gun assembly shown in FIG. 10, and FIG. 5 shows an equivalent circuit of the main lens of the electron gun assembly shown in FIG. 1. Based on these equivalent circuits, the ratio of the dynamic focus voltage, which is applied to the dynamic focus electrode and superimposed on the grid GM1 and grid GM2, was calculated for comparison between the prior art and the present invention. In the prior art, the ratio of superimposition on the grid GM1 was 66%, and the ratio of superimposition on the grid GM2 was 33%. By contrast, in the embodiment of the present invention, the ratio of superimposition on the seventh grid G7 (GM1) was 26%, and the ratio of superimposition on the eighth grid G8 (GM2) was 13%.

In the prior-art electron gun assembly wherein the main lens includes the auxiliary electrode to which a resistor-divided voltage is applied, if the dynamic focus voltage is applied to the dynamic focus electrode, a part of the AC component of the dynamic focus voltage is superimposed on the auxiliary electrode via capacitance between the auxiliary electrode and the electrodes on both sides of the auxiliary electrode. In this case, since the ratio of superimposition of the dynamic focus voltage is very high, undesirable lens functions occur in the asymmetrical lens formed between the dynamic focus electrode and auxiliary electrode and in the asymmetrical lens formed between the auxiliary electrode and the anode. Consequently, distortion of the beam spot cannot be corrected on the peripheral region of the phosphor screen, and good focus characteristics cannot be obtained over the entire region of the phosphor screen.

On the other hand, in the electron gun assembly according to the present embodiment, even if the dynamic focus voltage is applied to the dynamic focus electrode (G6), the ratio of the AC component superimposed on the seventh grid G7 (GM1) and eighth grid G8 (GM2) via inter-electrode capacitance can be reduced.

Thus, it is possible to suppress undesirable lens functions occurring between the dynamic focus electrode G6 and seventh grid G7 (GM1) and between the eighth grid G8 (GM2) and the anode G9. Therefore, good focus characteristics can be obtained over the entire region of the phosphor screen.

Furthermore, with the structure of the present embodiment, voltage supply terminals on the resistor for supplying voltage to plural auxiliary electrodes of the main lens, that is, the seventh grid G7 (GM1) and eighth grid G8 (GM2), can be disposed apart from each other. Thus, the problem on breakdown voltage in operation of the cathode ray tube apparatus can be solved.

Figure 11:
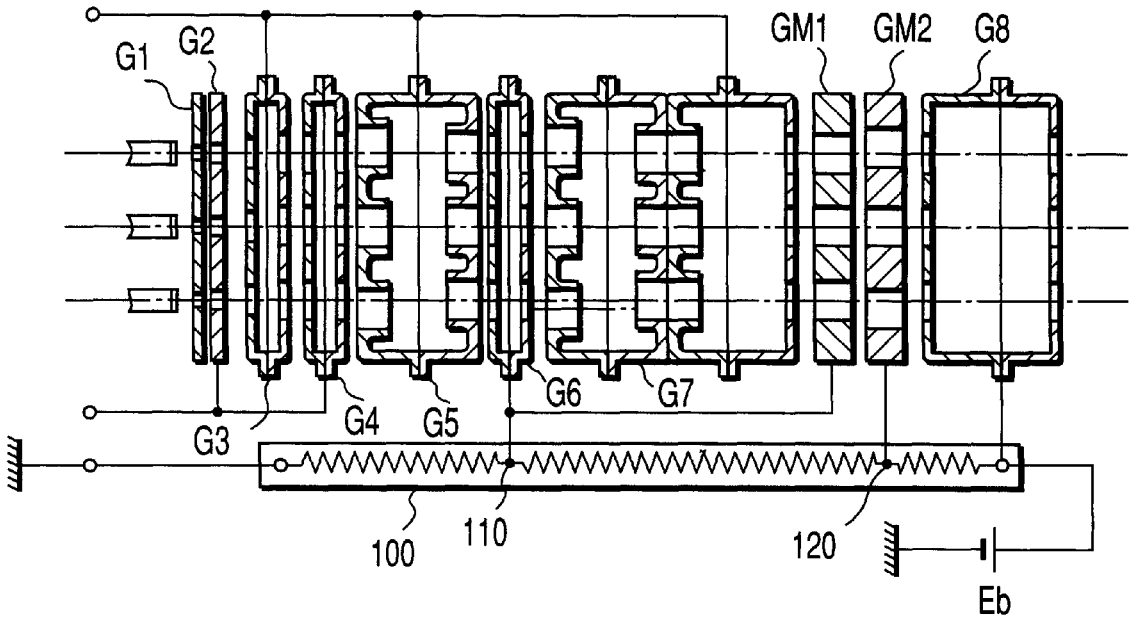
FIG. 11 PRIOR ART
FIG. 11 schematically shows the structure of another prior-art electron gun assembly.

Besides, with the structure of the present embodiment as shown in FIG. 1, as compared to the prior-art electron gun assembly shown in FIG. 11, the number of electrodes does not increase. According to this embodiment, the sub-lens electrode G4 in the prior art is constructed as the second auxiliary electrode G4 connected to the first auxiliary electrode G7 of the main lens. Thus, the manufacturing cost is not increased, and an error in the electron beam trajectory due to the increase in number of electron lenses can be prevented.

In the prior-art electron gun assembly shown in FIG. 11, the potentials of the grids G3, G4 and G5 of the sub-lens are high, low and high, respectively. In the electron gun assembly according to this embodiment, the potentials of the grids G3, G4 and G5 are low, high and low, respectively, and a uni-potential type acceleration sub-lens having a reverse relationship in potential, compared to the prior art, is formed. It is difficult to obtain a sufficient lens power with this acceleration sub-lens, compared to the prior-art sub-lens. A problem will arise if this acceleration sub-lens as such.

To solve the problem, in the present embodiment, the following relationship is established:

$$0.4\times\Phi \leq L \leq 1.7\times\Phi$$

where Φ is an average diameter of the opening in the fourth grid G4 (second auxiliary electrode), and L is the electrode length in the tube axis direction Z.

Thereby, with the electron gun assembly according to the present embodiment, the beam spot diameter of the electron beam falling on the phosphor screen can be reduced to a minimum.

Figure 6:
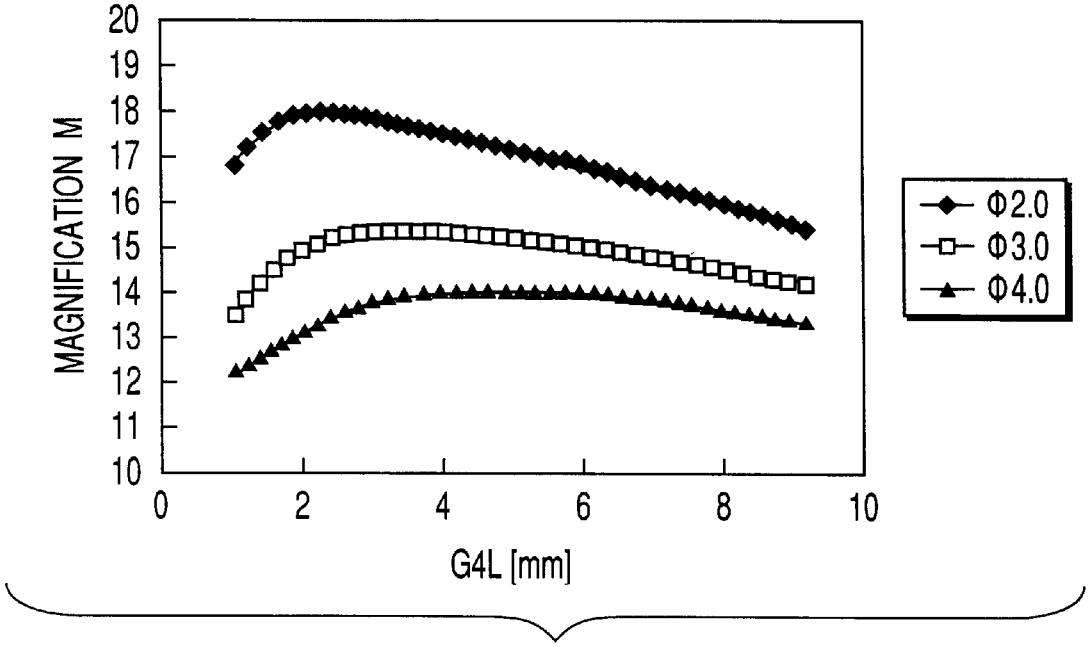
FIG. 6 is a graph showing a relationship between a magnification M and an electrode length G4L (mm) of a fourth grid G4 in the electron gun assembly using the acceleration type sub-lens, parameters in this graph being G4Φ.

FIG. 6 is a graph showing a relationship between a magnification M and an electrode length G4L (mm) of the fourth grid G4 in the electron gun assembly using the acceleration type sub-lens. The magnification M is a ratio of an image point size on the phosphor screen to an object point size in the electron beam generating section.

Assume that the focus electrode length in the electron gun assembly is 22.5 mm. The focus electrode length is a length in the tube axis direction from second grid (G2)-side end face of the third grid G3 to the seventh grid (G7)-side end face of the sixth grid G6, which substantially determines the length of the entire electron gun assembly. The lens diameter of the main lens is ϕ6.0 mm, and the voltage of the fourth grid G4 is 65% of anode voltage.

In FIG. 6, the magnification M relative to the electrode length G4L of the fourth grid G4 was calculated with respect to cases where the diameter Φ of the electron beam passage hole formed in the fourth grid G4 of the acceleration type sub-lens was 2 mm, 3 mm and 4 mm. As a result, it is understood that in a case where the acceleration sub-lens is adopted, the magnification M takes a maximum value when the electrode length G4L is increased. It is also understood that the maximum value of the magnification M will shift in a direction of increase of the electrode length G4L as the hole diameter Φ increases. At this time, an optimal value is present between the electrode length G4L and hole diameter Φ, and the magnification M takes a maximum value when the electrode length G4L becomes substantially equal to the hole diameter Φ.

Figure 7:
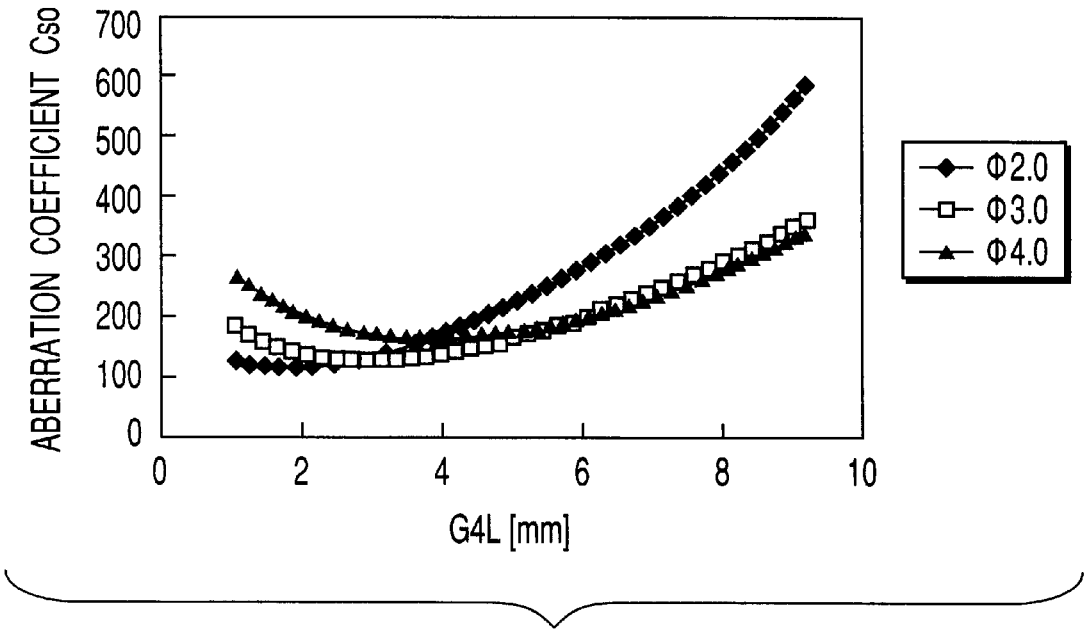
FIG. 7 is a graph showing a relationship between an aberration coefficient Cso and the electrode length G4L (mm) of the fourth grid G4 in the electron gun assembly using the acceleration type sub-lens, parameters in this graph being G4Φ.

FIG. 7 is a graph showing a relationship between an aberration coefficient Cso and an electrode length G4L (mm) of the fourth grid G4 in the electron gun assembly using the acceleration type sub-lens. The aberration coefficient Cso is a coefficient corresponding to a spherical aberration in the lens system comprising the acceleration sub-lens and the main lens.

Assume that the focus electrode length in the electron gun assembly is 22.5 mm. The lens diameter of the main lens is ϕ 6.0 mm, and the voltage of the fourth grid G4 is 65% of anode voltage.

In FIG. 7, the aberration coefficient Cso relative to the electrode length G4L of the fourth grid G4 was calculated with respect to cases where the diameter Φ of the electron beam passage hole formed in the fourth grid G4 of the acceleration sub-lens was 2 mm, 3 mm and 4 mm. As a result, it is understood that in a case where the acceleration sub-lens is adopted, the aberration coefficient Cso takes a minimum value when the electrode length G4L is increased. It is also understood that the minimum value of the aberration coefficient Cso will shift in a direction of increase of the electrode length G4L as the hole diameter Φ increases. At this time, an optimal value is present between the electrode length G4L and hole diameter Φ, and the aberration coefficient Cso takes a minimum value when the electrode length G4L becomes substantially equal to the hole diameter Φ.

Figure 8:
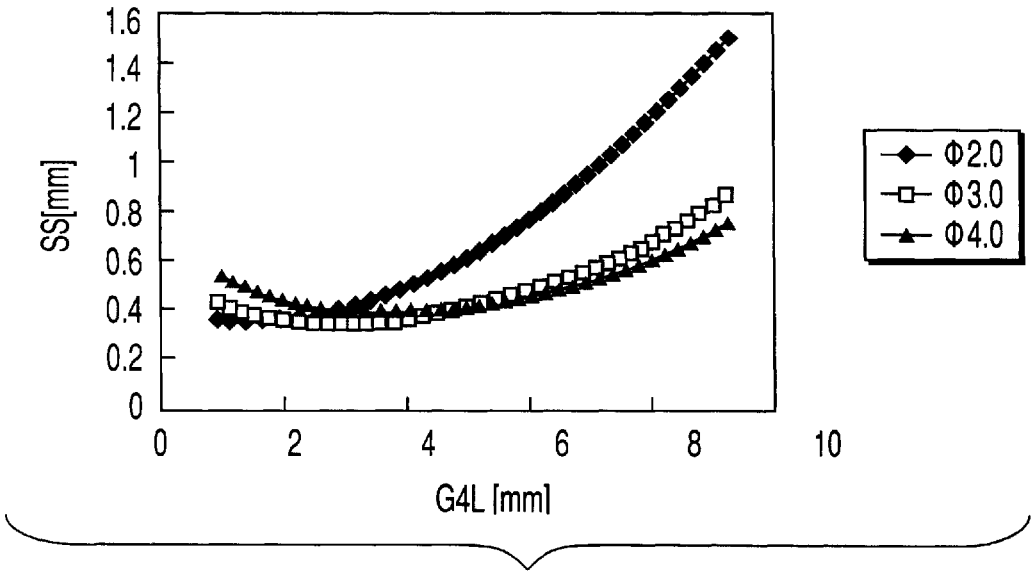
FIG. 8 is a graph showing a relationship between a beam spot size SS (mm) on a central portion of a phosphor screen and the electrode length G4L (mm) of the fourth grid G4 in the electron gun assembly using the acceleration type sub-lens, parameters in this graph being G4Φ.

FIG. 8 is a graph showing a relationship between a beam spot size SS (mm) on the central portion of the phosphor screen and an electrode length G4L (mm) of the fourth grid G4 in the electron gun assembly using the acceleration type sub-lens.

Assume that the focus electrode length in the electron gun assembly is 22.5 mm. The lens diameter of the main lens is ϕ6.0 mm, and the voltage of the fourth grid G4 is 65% of anode voltage.

In FIG. 8, the beam spot size SS relative to the electrode length G4L of the fourth grid G4 was calculated with respect to cases where the diameter Φ of the electron beam passage hole formed in the fourth grid G4 of the acceleration sub-lens was 2 mm, 3 mm and 4 mm. As a result, it is understood that in a case where the acceleration sub-lens is adopted, the beam spot size SS takes a minimum value when the electrode length G4L is increased. It is also understood that the minimum value of the beam spot size SS will shift in a direction of increase of the electrode length G4L as the hole diameter Φ increases. At this time, an optimal value is present between the electrode length G4L and hole diameter Φ, and the beam spot size takes a minimum value when the electrode length G4L becomes substantially equal to the hole diameter Φ.

On the other hand, in the prior-art sub-lens (high-low-high), the characteristics of the magnification, aberration coefficient and beam spot size relative to the electrode length of the fourth grid will simply increase or decrease as the electrode length of the fourth grid increases, without taking minimum and maximum values.

Figure 9:
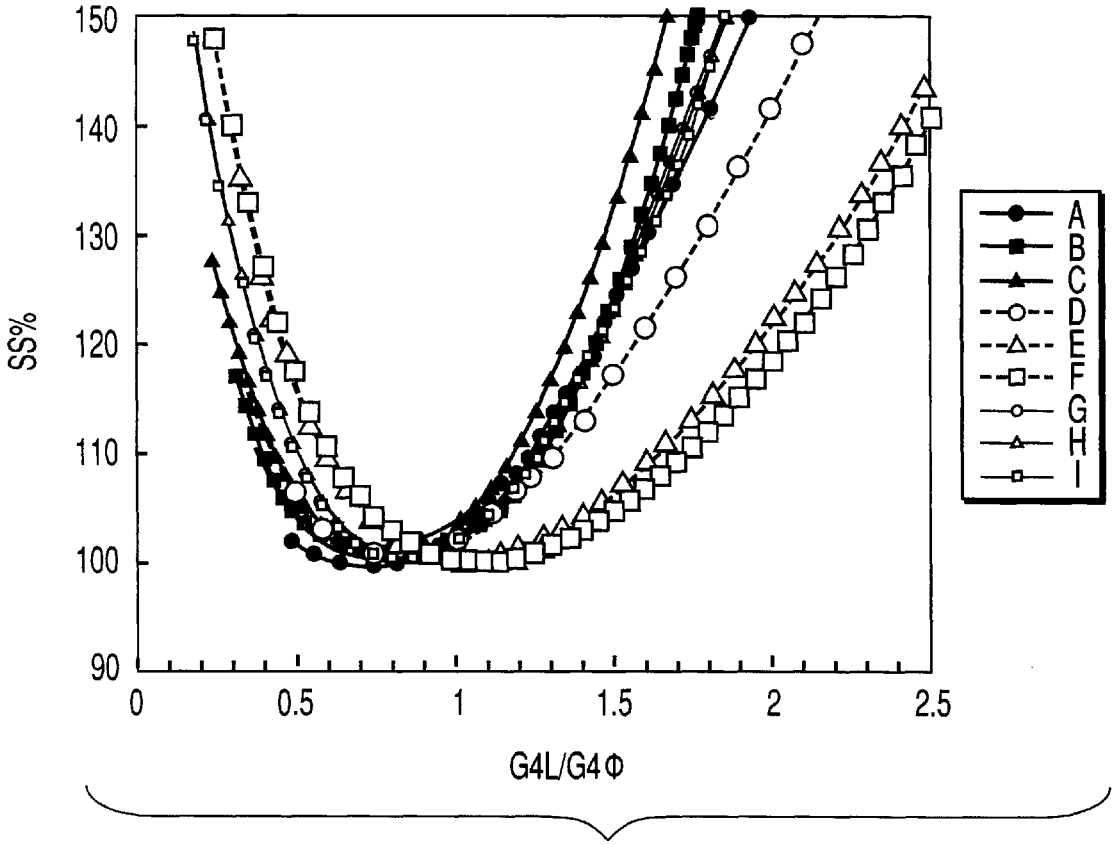
FIG. 9 is a graph showing a relationship between a spot size SS %, standardized by a minimum spot size, and a ratio (G4L/G4Φ) of the electrode length G4L of the fourth grid G4 to a diameter G4Φ of an electron beam passage hole formed in the fourth grid G4.

FIG. 9 is a graph showing a relationship between a beam spot size SS %, standardized by a minimum spot size, and a ratio (G4L/G4Φ) of an electrode length G4L of the fourth grid G4 to a hole diameter G4Φ of the electron beam passage hole formed in the fourth grid G4 in the electron gun assembly using the acceleration type sub-lens.

Curves A, B and C in the graph were obtained when the electron gun length in the electron gun assembly is 22.5 mm and the lens diameter of the main lens is ϕ 6.0 mm, and are associated respectively with cases where the diameter Φ of the electron beam passage hole formed in the fourth grid G4 of the acceleration sub-lens was 2 mm, 3 mm and 4 mm.

Curves D, E and F in the graph were obtained when the electron gun length in the electron gun assembly is 16.9 mm and the lens diameter of the main lens is ϕ 6.0 mm, and are associated respectively with cases where the diameter Φ of the electron beam passage hole formed in the fourth grid G4 of the acceleration sub-lens was 2 mm, 3 mm and 4 mm.

Curves G, H and I in the graph were obtained when the electron gun length in the electron gun assembly is 22.5 mm and the lens diameter of the main lens is ϕ 8.0 mm, and are associated respectively with cases where the diameter Φ of the electron beam passage hole formed in the fourth grid G4 of the acceleration sub-lens was 2 mm, 3 mm and 4 mm.

In general, the design limit of the spot size is −10% of the best size. From this standpoint, a feasible range of design is a range of 110% or less of the minimum spot size which is assumed to be 100%. Specifically, an approximately minimum best size of the electron beam spot can be designed by establishing the following relationship, $$0.4\times\Phi \leqq L \leqq 1.7\times\Phi.$$

There is a tendency that the characteristics of the spot size SS % relative to the value G4L/G4Φ shown in FIG. 9 do not greatly vary depending on the electron gun length and the hole diameter of the grid of the main lens and the voltage of the fourth grid G4. In addition, the range of optimal values does not greatly vary. In fact, even if the voltage of the fourth grid G4 is set at 49% Eb, the same result can be obtained.

Accordingly, the optimal beam spot size can be obtained with the electron gun assembly having the acceleration type sub-lens satisfying the above relationship.

The advantages of the present invention are not limited to the above.

The electron beam speed is accelerated by the acceleration type sub-lens composed of the third, fourth and fifth grids before it enters the main lens (the electron beam speed is decelerated in the prior-art (low-high-low) type sub-lens). Thus, a chromatic aberration component caused by the main lens is advantageously less than in the prior art. Even with the same electron gun length, the focus voltage may relatively decrease and the dynamic focus voltage may be advantageously low.

In the above-described embodiment, two of the grids of the main lens are supplied with voltages from the resistor, and these two grids are supplied with voltages from different voltage supply terminals. However, the present invention is not limited to this example.

Figure 2:
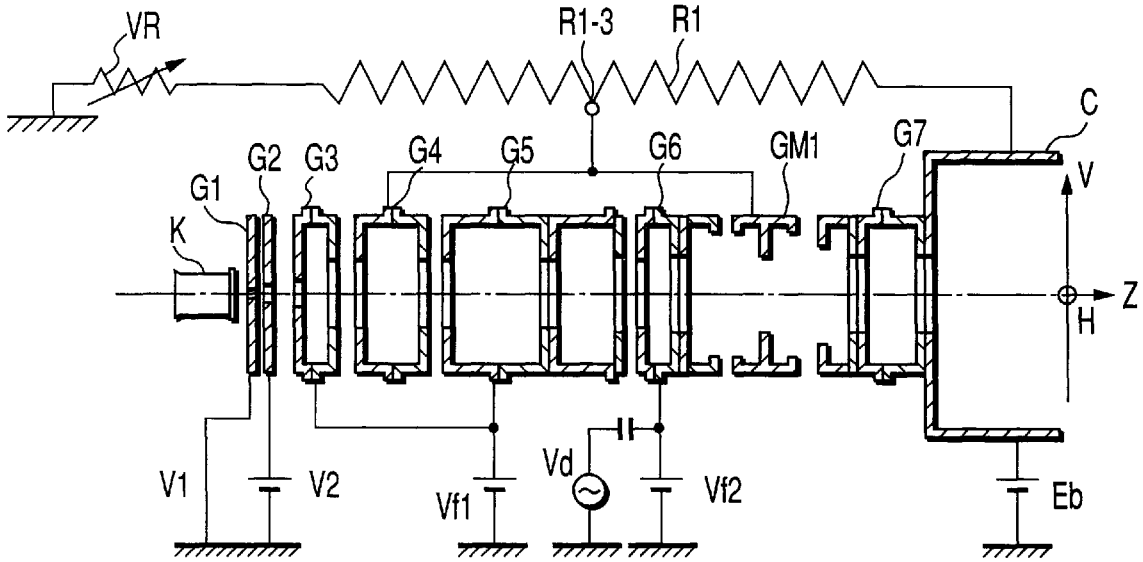
FIG. 2 is a vertical cross-sectional view schematically showing another embodiment of the electron gun assembly, which is applied to the cathode ray tube apparatus of the present invention.

Specifically, as shown in FIG. 2, the main lens may be composed of a dynamic focus electrode G6 supplied with a dynamic focus voltage, an anode G7 supplied with an anode voltage, and a first auxiliary electrode GM1 disposed between the dynamic focus electrode G6 and anode G7. With this structure, the first auxiliary electrode GM1 is connected to a second auxiliary electrode G4 within the tube and supplied with a voltage from a single voltage supply terminal R1-3 on the resistor R1.

In this electron gun assembly, an electron beam passage hole common to three electron beams is formed in each of the face of the dynamic focus electrode G6, which is opposed to the first auxiliary electrode GM1, the faces of the first auxiliary electrode GM1, which are opposed respectively to the dynamic focus electrode G6 and the anode G7, and the face of the anode G7, which is opposed to the first auxiliary electrode GM1.

Thereby, like the above-described embodiment, even if the dynamic focus voltage is applied to the dynamic focus electrode G6, it is possible to reduce the ratio of superimposition of the AC component, which is superimposed on the first auxiliary electrode GM1 via the inter-electrode capacitance.

Thus, it is possible to suppress undesirable lens functions occurring between the dynamic focus electrode G6 and first auxiliary electrode GM1 and between the first auxiliary electrode GM1 and the anode G7. Therefore, good focus characteristics can be obtained over the entire region of the phosphor screen.

Furthermore, since only one voltage supply terminal is provided on the resistor for supplying a voltage to the first auxiliary electrode GM1 of the main lens, the problem on breakdown voltage in operation of the cathode ray tube apparatus can be solved.

Besides, since the number of electrodes can be reduced, the manufacturing cost is not increased and an error in the electron beam trajectory due to the increase in number of electron lenses can be prevented.

As has been described above, the present invention can provide a cathode ray tube apparatus wherein a disadvantage on breakdown voltage is eliminated and well-shaped beam spots can be formed over an entire phosphor screen without increasing manufacturing cost.

Besides, in the present invention, the term "the electrode to which a fixed voltage is applied" means an electrode to which a voltage varying over time, such as a dynamic voltage, is not intentionally applied, and to which a substantially invariable voltage in practical use is applied.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube apparatus comprising:

an electron gun assembly including an electron beam generating section for generating at least one electron beam, and a main focus lens section for focusing the electron beam on a screen; and a deflection yoke for generating deflection magnetic fields for deflecting and scanning the electron beam from the electron gun assembly on the screen in horizontal and vertical directions, wherein the main focus lens section comprises at least one focus electrode, to which a fixed focus voltage of a first level is applied, at least one anode to which an anode voltage of a second level higher than the first level is applied, at least one first auxiliary electrode to which a voltage obtained by resistor-dividing the anode voltage via a resistor and having a third level higher than the first level and lower than the second level is applied, and at least one dynamic focus electrode to which a dynamic focus voltage obtained by superimposing on a focus voltage an AC voltage varying in synchronism with the deflection magnetic fields generated by the deflection yoke is applied, the main focus lens section includes an ultimate main focus lens section composed of the dynamic focus electrode, said at least one first auxiliary electrode and the anode, which are arranged successively in a direction of travel of said electron beam, and at least one second auxiliary electrode connected to the first auxiliary electrode is provided on the electron beam generating section side of the ultimate main focus lens section, and an electrode to which a fixed voltage is applied is disposed near the second auxiliary electrode.

2. A cathode ray tube apparatus according to claim 1, wherein the second auxiliary electrode is interposed between a pair of said focus electrodes to which the fixed focus voltage is applied.

3. A cathode ray tube apparatus according to claim 1, wherein the second auxiliary electrode has an electron beam passage hole formed to correspond to the electron beam generated by the electron beam generating section, and the following relationship is established:

$$0.4\times\Phi \leqq L \leqq 1.7\times\Phi$$

where Φ is an average diameter of the electron beam passage hole and L is the electrode length.

4. A cathode ray tube apparatus according to claim 2, wherein said second auxiliary electrode and said pair of focus electrodes constitute a uni-potential type sub-lens section.

5. A cathode ray tube apparatus according to claim 4, wherein the focus electrode of the sub-lens section and the dynamic focus electrode of the ultimate main focus lens section are disposed adjacent to each other, and a multipolar lens varying in synchronism with the deflection magnetic fields is created between said focus electrode and said dynamic focus electrode.

6. A cathode ray tube apparatus according to claim 1, wherein an asymmetric lens component having different lens powers in horizontal and vertical directions is provided in a lens space created by the first auxiliary electrode and the anode of the ultimate main focus lens section.

7. A cathode ray tube apparatus according to claim 6, wherein the asymmetric lens component has a diverging lens function in the vertical direction and a focusing lens function in the horizontal direction in a relative manner.

8. A cathode ray tube apparatus according to claim 1, wherein an asymmetric lens component having different lens powers in horizontal and vertical directions is provided in a lens space created by the first auxiliary electrode and the dynamic focus electrode of the ultimate main focus lens section.

9. A cathode ray tube apparatus according to claim 8, wherein the asymmetric lens component has a focusing lens function in the vertical direction and a diverging lens function in the horizontal direction in a relative manner.

* * * * *